United States Patent [19]

Ziegler

[11] 4,385,501

[45] May 31, 1983

[54] HOT GAS COOLER

[75] Inventor: Georg Ziegler, Winterthur, Switzerland

[73] Assignee: Sulzer Brothers Limited, Winterthur, Switzerland

[21] Appl. No.: 302,662

[22] Filed: Sep. 15, 1981

[30] Foreign Application Priority Data

Sep. 19, 1980 [CH] Switzerland ..... 7052/80

[51] Int. Cl.[3] ..... G01K 13/00

[52] U.S. Cl. ..... 62/129; 62/430; 165/154

[58] Field of Search ..... 62/430, 125, 129; 165/154, 155, 156

[56] References Cited

U.S. PATENT DOCUMENTS

| | | | |
|---|---|---|---|
| 1,734,262 | 11/1929 | Lütschen | 165/154 |
| 1,983,832 | 12/1934 | Bailey | 165/154 |
| 2,215,729 | 9/1940 | Ruttimann | 165/154 |
| 2,991,981 | 7/1961 | Andersen | 165/156 |
| 3,967,591 | 7/1976 | Iida | 165/154 |
| 4,013,122 | 3/1977 | Long | 165/154 |
| 4,228,848 | 10/1980 | Wadkinson, Jr. | 165/156 |

*Primary Examiner*—Ronald C. Capossela

*Attorney, Agent, or Firm*—Kenyon & Kenyon

[57] ABSTRACT

The hot gas cooler has a cooling insert of tubes in the pressure vessel. At the hot gas entry end, the cooling insert is connected, to a hot gas source. The insert interior communicates with the gap between the insert and the pressure vessel for pressure compensation. The pressure-compensating communication is disposed near the hot gas entry and extends by way of an additional cooling path. In the event of a gas-side leakage of the cooling insert, hot gas cannot flow into the gap between the insert and the pressure vessel.

7 Claims, 2 Drawing Figures

HOT GAS COOLER

Figure 2:
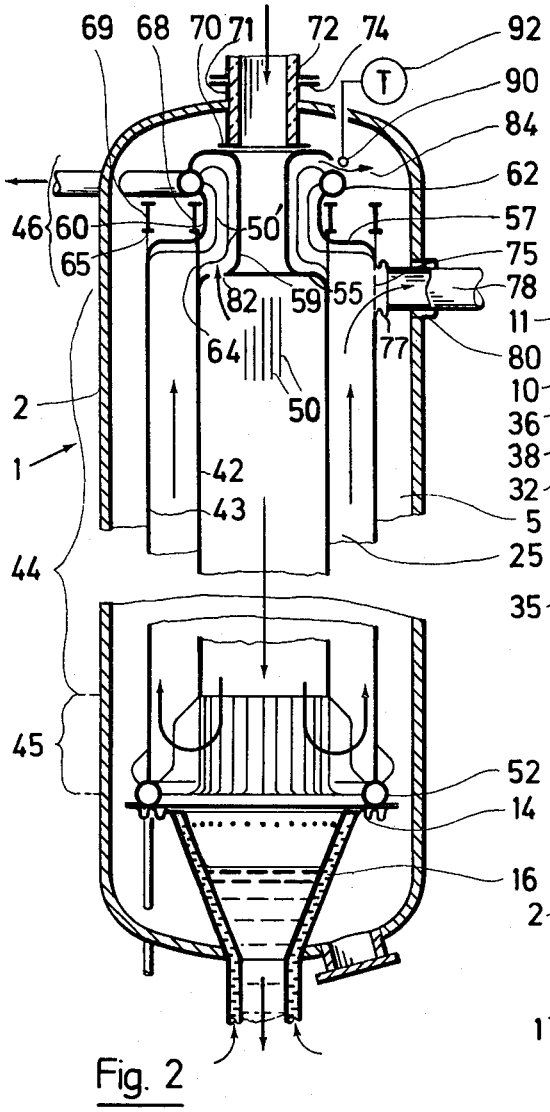

This invention relates to a hot gas cooler. More particularly, this invention relates to a hot gas cooler with a pressure vessel.

Heretofore, coolers for a hot gas have been constructed with a pressure vessel in which a cooling insert is disposed in order to protect the walls of the pressure vessel from overheating. Usually, the cooling insert is constructed of tubes which are secured together, as by welding, in a seal-tight manner and through which a suitable heat exchange or cooling medium can be conveyed. In some cases the cooling insert is connected at the hot gas entry end by an entry passage which extends through the pressure vessel wall to a hot gas source and communicates with an exit passage which extends through the pressure vessel wall. In order to compensate for pressure differences between the insert interior and the space between the insert and the pressure vessel wall, it has been known to connect the insert interior with the space between the insert and vessel wall.

Generally, a cooler of this kind must have provision for insuring that the pressure in this space between the insert a pressure vessel wall remains within permissible limits. It is a fairly obvious step to provide communication between the insert interior and the space between the insert and vessel wall at a place where the gas temperature is lowest so that the hot gas which flows into the space in response to pressure various is at the lowest temperature. However, this has the disadvantage that, in the event a gas leak in the insert upstream of the point of communication, relatively hot gas may enter the space. As a result, there is a risk of overheating the pressure vessel wall.

Accordingly, it is an object of the invention to avoid overheating of a pressure vessel wall of a hot gas cooler containing an insert for conducting a flow of hot gas therethrough.

It is another object of the invention to provide a hot gas cooler with a means to compensate for pressure differences within a hot gas cooler while preventing the overheating of a pressure vessel wall.

Briefly, the invention provides a hot gas cooler which is comprised of a pressure vessel having a peripheral wall, a cooling insert within the vessel to define a gap and a flow chamber for passage of a hot gas, first means connecting the flow chamber adjacent an entry end with the gap for compensating the pressure therebetween and a second means for cooling the hot gas passing through the first means.

In this arrangement, the pressure vessel is at the highest possible pressure and the insert is at the outer positive pressure and not the inner positive pressure. Of note, both of these conditions are disadvantageous; however, the advantage is that in the event of a leak occurring anywhere in the insert, either the gap is through-flowed only by gas which has been cooled within the cooler or (if the leak is near the entry) and gas flows in the gap. Since the gas stagnates in the cooler during normal operation, the gas stays clean and therefore requires no cleaning.

The cooling insert is constructed of a plurality of tubes for conveying a cooling medium therethrough. In addition, the insert has an entry end for receiving a flow of hot gas at the upper end prior to entry into the flow chamber.

In one embodiment, the insert includes a reduced neck at an upper end which extends through the vessel and an exhaust at a lower end. In addition, a funnel communicates with the exhaust and passes through the vessel at the lower end. In this case, the flow of hot gas is directly through the insert and the pressure vessel.

In another embodiment, the insert is formed of an inner jacket and an outer casing which together define a second annular gap therebetween. In this case, the jacket has a reduced neck at the upper end defining the entry end to the flow chamber. Also, the jacket has a plurality of peripheral openings adjacent a lower end communicating with the gap between the jacket and casing as well as an exhaust opening for slag particles at the lower end. This opening may also communicate with a funnel provided with a means for discharging the slag particles.

This latter embodiment also has at least one exhaust gas passage communicating an upper end of the gap between the outer casing and the pressure vessel wall with the exterior of the vessel. In addition, the means for compensating the pressure includes an aperture in an upper end of the jacket and a second aperture in the upper end of the casing in order to communicate the flow chamber with the gap between the outer casing and the pressure vessel wall. The means of cooling the hot gas passing between these apertures includes various tubes of the jacket and casing which are bent into the gap between the jacket and casing so as to cool the hot gas passing thereover.

In the latter embodiment, the hot gas flow is not rectilinear but rather convoluted. In this case, the pressure vessel occupies a relatively small space and is relatively short in length. Further, where the tubes of the jacket and casing provide the cooling surfaces for the cooling of the hot gas, such provides a convenient use of the available elements as the cooling means.

In order to detect leaks, a temperature sensor can be disposed in the gap between the insert and the pressure vessel wall. In the case of a substantial leak, the temperature of the gas near the exit from the cooling means would rise. Thus, the measure of the temperature increase provides a good yardstick as to the extent of the leak.

In addition, a second temperature sensor may be provided in the gap between the insert and pressure vessel wall diametrically opposite and at the same height and the same radius as the first temperature sensor. This permits a comparison of the measured temperatures so that leaks can be detected during starting and stopping as well as on load alterations.

Figure 1:
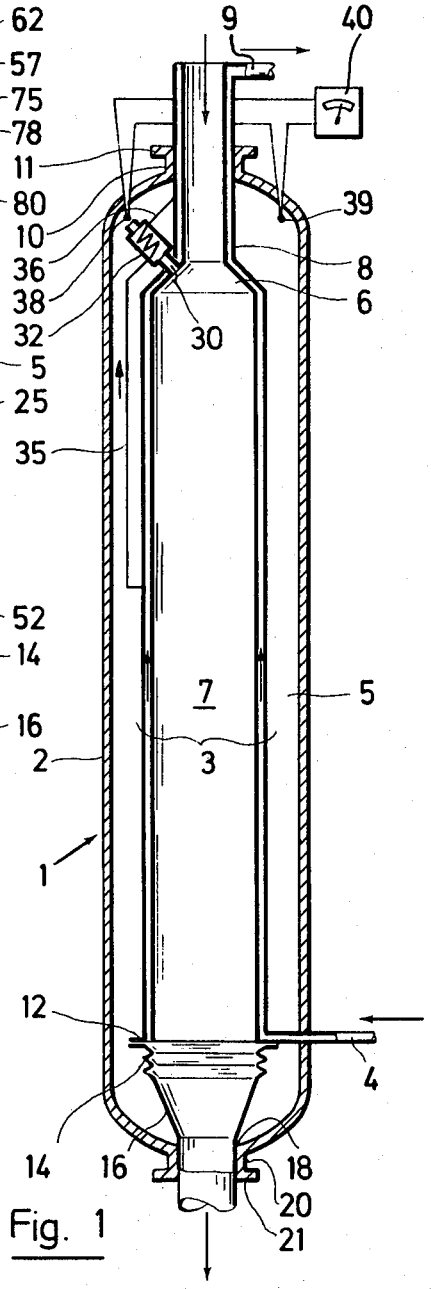

These and other objects and advantages of the invention will become more apparent from the following detailed description taken in conjunction with the accompanying drawings wherein:

FIG. 1 illustrates a longitudinal cross-sectional view of hot gas cooler according to the invention; and FIG. 2 illustrates a longitudinal cross-sectional view of a modified hot gas cooler according to the invention.

Referring to FIG. 1, the hot gas cooler 1 includes a pressure vessel having a peripheral wall 2 and a double-walled cylindrical cooling insert 3 disposed within the vessel in spaced relation to the wall 2 to define a gap 5. The insert 3 is supplied with a cooling medium such as water at the bottom via a radially disposed spigot 4 or the like. At the top, the insert 3 merges through a conical surface 6 into a reduced neck 8. This neck 8 communicates with an exit spigot 9 or the like for exhausting the cooling medium. As indicated, the neck 8 extends through a spigot 10 in the upper end of the pressure vessel 2 to define an entry end for receiving a flow of hot gases from a suitable source. The spigot 10 also has a flange 11 as indicated.

The insert 3 defines a flow chamber 7 for the passage of the hot gas from the entry end and has an exhaust at a lower end. As indicated, the lower end of the insert 3 has a flange 12 to which a funnel 16 is connected in sealed relation by a bellows 14. The funnel 16 includes a neck 18 which extends through a spigot 20 in the pressure vessel 2. The spigot 20 also has a flange 21 as the spigot 10.

The reduced neck 8 of the insert 3 and the neck 18 of the funnel 16 are in gas-tight communication with the respective spigots 10, 20.

When the insert 3 forms a gas-tight system between the necks 8, 18, the pressure in the enclosed gap 5 between the insert 3 and the pressure vessel 2 depends upon temperature and, therefore, varies considerably. This pressure may be controlled by providing small means for compensating the pressure between the flow chamber 7 and the gap 5. This means maybe in the form of a communicating passage or orifice which is disposed at a place where the cooling medium in the insert 3 is at the lowest temperature so that the gas which flows into the gap 5 in response to an increase in the pressure of the hot gas is exclusively gas at the lowest pressure.

In the present case, a pressure compensating means 30 in the form of a tubular passageway is provided near the conical surface 6 and extends into the gap 5 by way of a cooling means, such a cooler 32, for cooling the hot gas passing through the tubular passageway 30. The cooler 32 is connected in parallel with the flow path of the coolant in the insert 3 via a feed-line 35 and a discharge-line 36.

As shown in FIG. 1, a temperature sensor in the form of a thermocouple 38 is disposed at the exit of the cooler 32 while a second thermocouple 39 is disposed in the gap 5 diametrically opposite and at the same height and same radius as the thermocouple 38. The thermocouples 38, 39 are electrically connected in series with an indicator 40. In this way, a signal received by the indicator 40 is proportional to the temperature difference between the zones associated with the thermocouples 39, 38.

In normal operation, a gas from a hot gas source (not shown) flows at a temperature of for example 1400° C. through the neck 8 into the flow chamber 7 of the insert 3 and yields heat therein, mainly by gas radiation, to the cooled insert 3. This gas then leaves the insert 3 at a temperature of approximately 500° C. via the neck 18 of the funnel 16. A pressure equal to the pressure on the conical surface arises in the gap 5 since, at start-up of the cooler, as the pressure in the insert 3 increases, gas flows through the tubular passageway 30 and cooler 32 into the gap 5. The stagnant gas therein then takes up a temperature somewhere between the wall temperature of the insert 3 and the wall temperature of the pressure vessel 2.

If a leak occurs, for example in the bellows 14, a flow which depends upon the pressure drop between the conical surface 6 and the bellows 14 occurs in the gap 5. The hot gas in then cooled down to a permissible temperature in dependence upon the quantity of gas flowing through the leak. Since the temperature drop in the cooler 32 is less for a large throughput than for a small throughput, this temperature drop can be a measure of the extent of the leak. Thus, the temperature drop can be measured by determination of a temperature at the entry and exit of the cooler 32 or by comparison with the undisturbed temperature as indicated in FIG. 1.

Instead of using an indicator 40, an alarm can be provided which can operate a shut-down facility directly in response to a high enough input signal.

Referring to FIG. 2 wherein like reference characters indicate like parts as above, the cooler can be constructed of a more compact shape wherein the flow of hot gas is not rectilinear but rather convoluted. To this end, the insert comprises a shell or jacket 42 and a casing 43 which are concentrically disposed in cylindrical manner within a central portion 44. The jacket 42 and the casing 43 each consist of tubes 50 which are secured together via webs, for example by welding, so as to form seal-tight walls. As indicated, the jacket 42 and casing 43 define an annular gap 25.

The tubes 50 of the jacket 42 are forked in a bottom zone 45 in order to define a plurality of peripheral openings adjacent the lower end of the insert to communicate the flow passage with the annular gap 25.

The tubes 50 of the jacket 42 and casing 43 are all connected at the bottom ends to a common distributor 52 with some of the tubes 50 of the casing 43 bent outwardly in elbow fashion from the cylinder surface so that the entry orifices of the tubes 50 are not disposed on the same generatrix in the distributor 52. If otherwise, the entry orifices would weaken the distributor 52. For the zone 45 the webs which connect the tubes of the casing 43 extend between the straight-lined tubes so that the casing 43 forms a gas tight wall within the bottom zone 45.

The tubes 50 of the jacket 42 and casing 43 are also bent in an upper zone 46 above the central zone 44 towards the axis of the pressure vessel. As indicated, some of the pipes forming the jacket 42 and some of the pipes forming the casing 43 define respective gas-tight shoulder surfaces 55, 57 which merge into gas-tight necks 59, 60. In addition, some of the tubes 50' near the transitions to the shoulders 55, 57 become superfluous for forming a seal tight wall. These tubes 50' thus extend as a free bunch between the shoulders 55, 57 and the necks 59, 60. All of the tubes 50' then join a common ring collector or main 62 which is disposed in a horizontal plane coaxially in the pressure vessel 2.

As shown, the jacket 42 and casing 43 are suspended by way of hangers 64, 65 on two rings 68, 69 of beams. In addition, the hangers 64 are connected to a seal-tight cylindrical wall in the region between the two shoulders 55, 57.

At the top edge of the neck 59, the tubes of the neck 59 are bent first outwardly and then downwardly and are interconnected in seal tight manner via webs (not shown). The top edge of the neck 59 merges into an inner flange 70 of a stub pipe 71 which carries insulation 72 on an inwardly directed edge. The stub pipe 71 also has a flange 74 to which a hot gas source (not shown) is connected.

The casing 43 is formed with an aperture 75 near the top of the gap 25 between the jacket 42 and casing 43 for the exhaustion of the cooled gas. This aperture 75 is formed by bending out the tubes of the casing 43 and the omission of the webs between the tubes. In addition, a bellows 77 is disposed about the aperture 75 in seal-tight relation with the casing 43 and connects with a gas exhaust tube 78 which passes through the pressure vessel 2. To this end, the tube 78 extends through a resilient sleeve 80 which is secured to the vessel wall 2 in order to reduce heat expansion effects.

In addition, as in FIG. 1, a funnel 16 is connected via a bellows 14 to the bottom of the distributor 52 below the exhaust opening of the cooler. This funnel 16 is of double wall construction so as to be supplied with a coolant such as water and is provided with a series of openings near the upper end so as to permit the formation of a quenching bath within the funnel 16 for particles of slag or the like which drop out of the hot combustion gas within the cooler.

The means for compensating the pressure within the cooler includes a first aperture 82 in an upper end of the jacket 42 and a second aperture 84 in an upper end of the casing 43 in order to communicate the flow chamber within the jacket 42 with the gap 5 between the casing 43 and pressure vessel wall 2. As shown, the aperture 82 if formed in the jacket shoulder 55 and opens into the gap formed between the reduced necks 59, 60 of the jacket 42 and casing 43. The aperture 84 is formed in the bent out portion of the neck 59 of the jacket 42 above the ring collector 62. These apertures 82, 84 may be formed in the same manner as the aperture 75. In addition, the tubes 50' of the jacket 42 and casing 43 which are bent out into the space between the reduced necks 59, 60 form a means for cooling hot gas passing through this space. Thus, a cooling path is formed by the shoulder and neck walls which bound this space.

A temperature sensor 90 may also be provided directly at the exit of the aperture 84 with a signal line extending to an indicator 92. This temperature sensor 90 may also be placed within the cooling path.

During operation, the hot gases flow downwardly through the interior of the jacket 42 and are then deflected upwardly at the bottom end of the jacket 42 to pass upwardly within the gap 25 between the jacket 42 and casing 43. Thereafter, the gases exhaust from the gap 25 through the exhaust tube 78. During this time, most of the slag and soot particles in the gas drop by gravity into the funnel 16 and are removed via the water which is passed into the funnel 16.

During steady-state normal operation, the pressure at both ends of the pressure compensating passageway, i.e. at the apertures 82 and 84, is the same. In this case, there is no flow through space between the necks 59, 60. If a leak should occur, this would most probably be at a place where the internal gas pressure is lower than at the aperture 82. Such a leak therefore causes a gas flow from the aperture 82 through the aperture 84 past the temperature sensor 90. This flow can be detected on the indicator 92 as a temperature rise.

The tubes 50 which form the jacket 42 and casing 43 are, for example, heating surfaces, and perferably forced-flow evaporator heating surfaces, of a vapor generator. Further, these tubes 50 can be directly welded together in a gas-tight manner instead of being interconnected by webs.

The invention thus provides a gas cooler which not only provides for pressure compensation within the cooler but also reduces the risk of overheating of a pressure vessel wall should a leak occur.

What is claimed is:

1. A hot gas cooler comprising a pressure vessel having a peripheral wall, an inlet spigot for a hot gas at an upper end, and an outlet at a lower end;

a cooling insert including a plurality of tubes secured together in seal tight manner for conveying a cooling medium therethrough, said insert being disposed within said vessel in spaced relation to said wall to define an enclosed annular gap therebetween and having an entry end in communication with said inlet spigot for receiving a flow of hot gas at an upper end and a gas-tight flow chamber for passage of the hot gas;

first means connecting said flow chamber adjacent said entry end with said gap to convey hot gas therebetween for compensating the pressure therebetween; and second means for cooling the hot gas passing through said first means.

2. A hot gas cooler as set forth in claim 1 wherein said insert includes a reduced neck at an upper end extending through said vessel and an exhaust at a lower end, and which further comprises a funnel communicating with said exhaust and passing through said vessel.

3. A hot gas cooler as set forth in claim 1 wherein said insert includes an inner jacket and an outer casing defining a second annular gap therebetween, said jacket having a reduced neck at an upper end defining said entry end, a plurality of peripheral openings adjacent a lower end communicating with said second gap and an exhaust opening for the slag particles at the lower end; wherein said first means includes a first aperture in an upper end of said jacket and a second aperture in an upper end of said casing to communicate said flow chamber with said first gap; and which further comprises at least one exhaust gas passage communicating an upper end of said second gap with the exterior of said vessel.

4. A hot gas cooler as set forth in claim 3 wherein said jacket and said casing have tubes defining said second means for cooling hot gas passing between said first and second apertures.

5. A hot gas cooler as set forth in claim 1 which further comprises a first temperature sensor disposed in said gap near said first means.

6. A hot gas cooler as set forth in claim 5 which further comprises a second temperature sensor in said gap diametrically opposite and at the same height and the same radius as said first temperature sensor.

7. A hot gas cooler comprising a pressure vessel having a peripheral wall;

a double-walled cooling insert including a plurality of tubes for conveying a cooling medium therethrough, said insert being disposed within said vessel in spaced relation to said wall to define a gap therebetween and having a neck at an upper end secured to said vessel for receiving a flow of hot gas and a flow chamber for passage of the hot gas;

a funnel connected to a lower end of said insert in sealed relation and extending through said vessel in gas-tight relation;

first means connecting said flow chamber adjacent said entry end with said gap to convey hot gas therebetween for compensating the pressure therebetween; and second means for cooling the hot gas passing through said first means.

* * * * *